United States Patent [19]

Hanson

[11] 4,067,675

[45] Jan. 10, 1978

[54] APPARATUS FOR IN SITU LINING OF AN UPWARDLY OPEN SHAFT WITH MONOLITHIC CONCRETE

[76] Inventor: Raymond A. Hanson, c/o R.A. Hanson Co., P.O. Box 7400, Spokane, Wash. 99207

[21] Appl. No.: 694,209

[22] Filed: June 9, 1976

[51] Int. Cl.[2] ..... E21D 5/00

[52] U.S. Cl. ..... 425/59; 61/41 R; 166/287; 425/64

[58] Field of Search ..... 425/59, 63–65, 425/262, 456; 264/33, 34; 61/41, 84; 166/287

[56] References Cited

U.S. PATENT DOCUMENTS

| | | | |
|---|---|---|---|
| 233,826 | 10/1880 | Wilson | 425/63 |
| 1,006,248 | 10/1911 | Martin | 249/179 |
| 2,748,442 | 6/1956 | Butcher | 425/59 |
| 3,049,783 | 8/1962 | Hanson | 425/59 |
| 3,049,787 | 8/1962 | Hannan, Jr. et al. | 425/65 |
| 3,126,959 | 3/1964 | Ortloff | 166/287 |
| 3,377,669 | 4/1968 | Burgess | 425/59 |
| 3,958,637 | 5/1976 | Cobbs | 166/287 |

FOREIGN PATENT DOCUMENTS

| | | | |
|---|---|---|---|
| 623,264 | 11/1935 | Germany | 425/59 |

*Primary Examiner*—Francis S. Husar

*Assistant Examiner*—John McQuade

*Attorney, Agent, or Firm*—Wells, St. John & Roberts

[57] ABSTRACT

A slipform for lining upright shafts with monolithic concrete by pumping concrete downwardly under pressure to a slipform apparatus to simultaneously move the slipform apparatus upwardly within the shaft while concrete is being formed continuously into a monolithic lining within the shaft. The apparatus includes outer and inner slipform members. The outer member includes a sealing mechanism by which the area above the outer slipform is hydraulically sealed from the area below. The inner slipform fits within a conical recess of the outer slipform and includes a lower cylindrical portion for forming the open inside diameter of the lining. Concrete, in a plastic, wet condition, is pumped under pressure between the two slipform members to be molded against the shaft wall into an upwardly open monolithic concrete lining. Since the concrete is pumped between the two forms under pressure, a reaction force is created that operates upwardly against the slipform members. The concrete will thus act to push the forms upwardly within the shaft as it is pumped through the forms. The rate of ascent of the forms is timed in accordance with the setting time of the concrete. Thus, the upwardly moving forms leave a finished, hardened monolithic lining.

8 Claims, 6 Drawing Figures

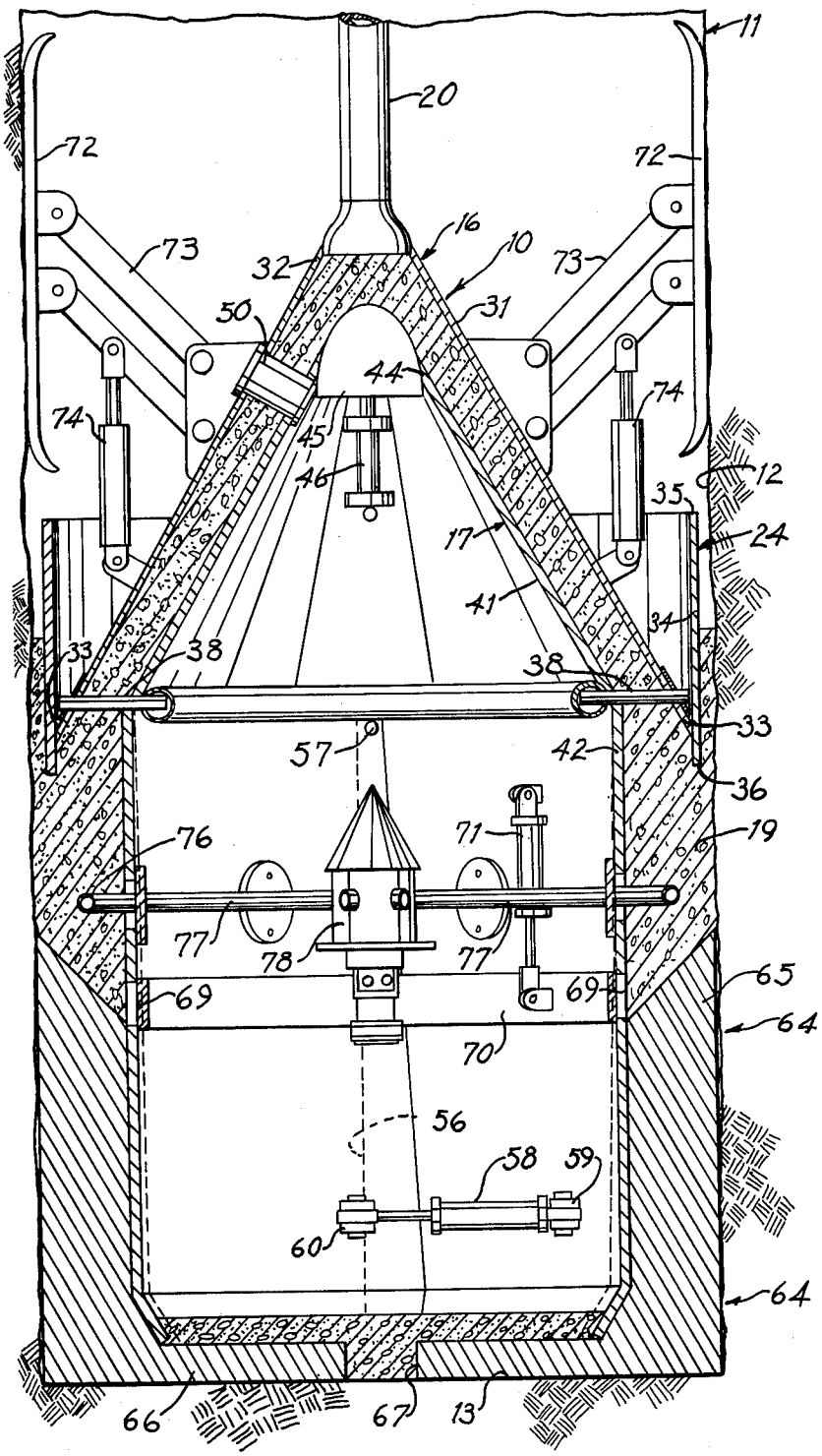
FIG 2
FIG 1
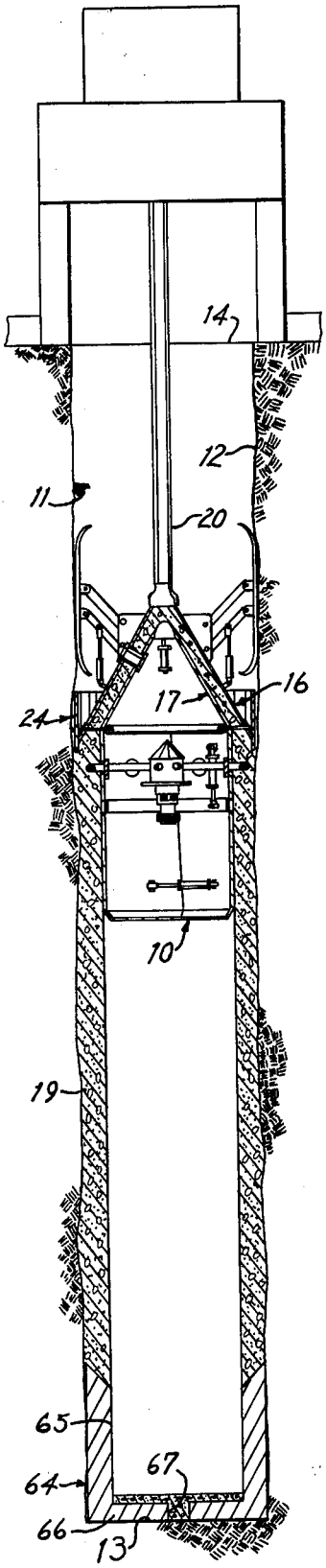

FIG 4
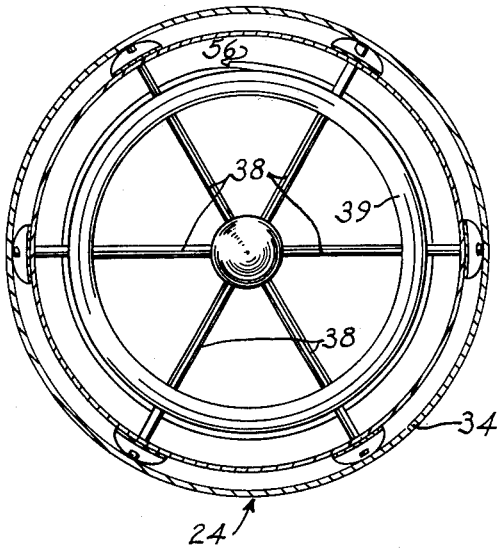
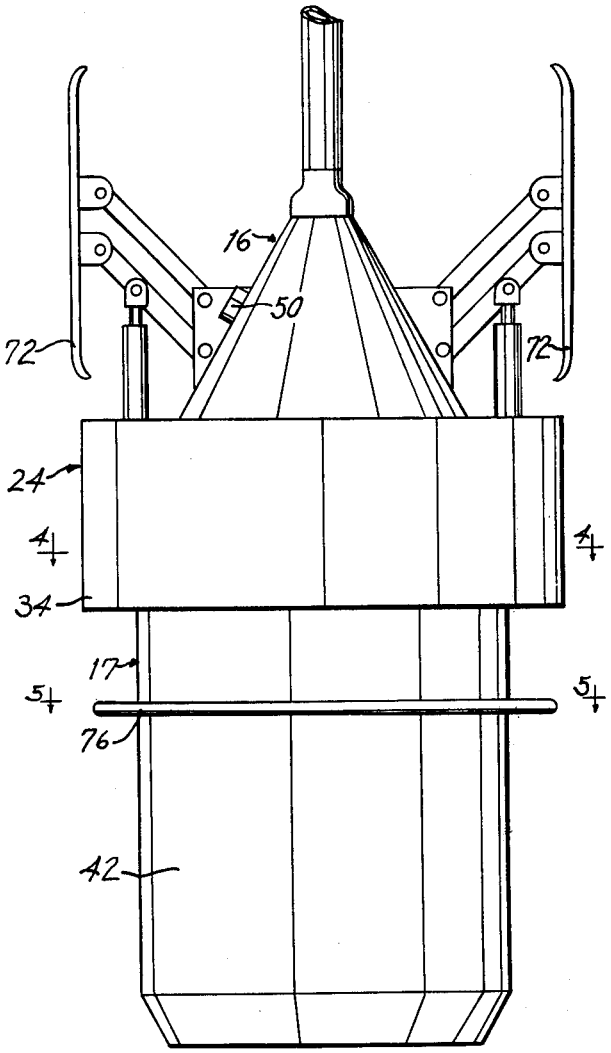
FIG 3
FIG 5
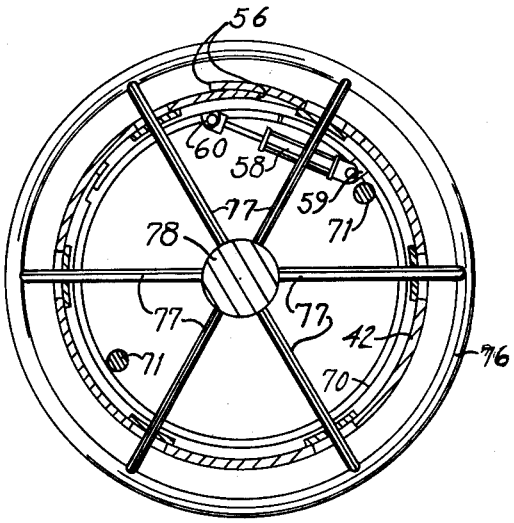

APPARATUS FOR IN SITU LINING OF AN UPWARDLY OPEN SHAFT WITH MONOLITHIC CONCRETE

BACKGROUND OF THE INVENTION

The present invention is related to shaft lining formula apparatus and particularly to such apparatus for forming vertical or upright monolithic concrete lining in-situ within mine shafts or similar excavations.

In mining operations, central mine shafts, winding shafts, blind shafts, and ventilation shafts are vertical in lead downwardly to and beyond horizontal tunnels. Such shafts may extend from the earth surface vertically downward to other adjoining tunnels, or they may extend from one tunnel vertically to another tunnel at a different elevation. Further, vertical shafts, termed "blind shafts," extend downwardly from one tunnel to a closed bottom end. Nearly all vertical shafts are lined with concrete or masonry to prevent the shaft walls from collapsing and isolating the adjoining tunnels. Various apparatus and methods have been produced for placing shaft linings in such upright open excavations. Most presently used apparatus and methods deal with the application of monolithic concrete lining rather than the application of masonry block or brick work lining.

U.S. Pat. No. 411,981, granted to W. Davis, discloses a method of cementing cisterns or wells. The disclosed process must be performed during the excavation process since the bottom of the shaft is utilized to support a retractable cylindrical form. The excavation is taken to a prescribed depth, then a form is laid in place at the bottom of the excavation. Concrete or cement is then poured about the form and allowed to harden between the form walls and shaft. Once the cement has hardened, the form is removed and the excavation is continued on downwardly past the ring of concrete previously formed. It is intended that this ring be utilized as both a portion of the shaft lining and as a "curbing" to hold the shaft walls intact during the remainder of the excavation operation. It is not disclosed how the shaft walls are lined between the cement rings or "curbing."

U.S. Pat. No. 233,826, granted to W. Wilson on Oct. 26, 1880, discloses an apparatus for lining wells. This device is comprised of two independent form members, one for defining an exterior lining surface and the remaining form for producing the lining interior surface. In operation, after the shaft has been excavated to a required depth, a section of cement tube is placed within the shaft and pressed against the bottom shaft end. This tube must have inside and outside diameters equal to the corresponding dimensions of the lining. Once this tube has been placed within the bottom of the shaft, the inside or core cylinder is lowered into the tube with a portion of its length extending above the top end of the tube. The outer cylinder is also put in place about the outside of the tube and also extends upwardly above the upper tube edge. A tubular receptacle is thereby formed into which cement or concrete may be poured and allowed to harden. Once the cement or concrete has hardened, the two form members may be slipped upwardly over the newly formed lining section to form the next successive batch of concrete poured on top of the previously poured section. In this manner, the well lining is produced in a succession of independent pours from the shaft bottom to top.

The "inchworm" movement of the form members is commonly known as "jump forming" and is typically used in shaft lining operations. This process has been reasonably effective. However, there does exist a line or joint between each successive pouring. Such joints may become weak areas that will allow collapse of the lining if the exterior pressure of the earth surrounding the shaft is excessive. An additional problem with "jump forming," since it involves peak labor periods, is relatively low production rates.

U.S. Pat. No. 1,313,013, granted to C. Polysu, on Aug. 12, 1919, disclosed a method and apparatus for casing wells. This apparatus is somewhat similar to the Davis device in that the lining is formed in a downward direction from the top of the shaft and is formed while the shaft is being excavated. This particular device utilizes a boring head with a concrete slipform following behind. The lining may be poured after the boring instrument has excavated a shaft to a depth equal to the height of the slipform member. The slipform itself is simply an inner core member that forms the inside bore of the lining. Concrete is pumped downwardly to the slipform and outwardly into the area between the slipform and boring head. As the shaft is excavated, the boring head moves downwardly and so does the slipform. Concrete is pumped into the area between the slipform and shaft as the slipform moves downwardly at a rate equal to the rate of excavation for the boring head. At the end of the boring operation the slipform must be left with the shaft since the full weight of the shaft lining rests upon the lower portion thereof. The setting or hardening time of the concrete being delivered to the slipform must be timed precisely with the advancement of the boring tool. Therefore, the conditions of the soil surrounding the shaft area must be very carefully considered and extremely prompt action must be taken when soil conditions change so the lining is not formed at an incorrect rate. For example, if the lining is formed too quickly the concrete will not properly harden and could very easily fall apart once the slipform moves downwardly leaving the wet concrete to support itself. Should the boring head move too slowly, the concrete could harden within the delivery tube and halt progression of the lining at that point.

U.S. Pat. No. 3,827,244, granted to H. Walbröhl on Aug. 6, 1974, discloses a form for producing a concrete lining of mine galleries, tunnels, shafts, or the like. In this instance, a slipform is pulled directly behind a tunneling cutter. It includes a relatively short forming member that receives and forms concrete about its periphery against the tunnel walls and a series of thrust members that are utilized to support the "green" concrete until it reaches a sufficiently stable form to support itself and withstand the pressure exerted by the earth around the tunnel. The thrust members are pulled along with the forming head at a rate such that the last thrust member leaves the concrete lining surface exposed as that surface reaches a hardened condition. It is the "shutters" or reinforcing rib members that are the central subject of this patent, not the specific details of a slipform. The slipform itself is pulled along as it receives concrete in a wet plastic form by a boring mechanism. No disclosure is made as to the utilization of fluid pressure behind the slipform mechanism to "push" the slipform along the shaft or tunnel.

Other patents of general interest are U.S. Pat. No. 3,270,511, granted on Sept. 6, 1966, to E. Colly and U.S. Pat. No. 3,768,267, granted on Oct. 30, 1973 to N. Chlumecky. Also, further background material may be had with reference to my U.S. Pat. No. 3,877,855 granted Apr. 15, 1975.

SUMMARY OF THE INVENTION

It is a primary object of the present invention to provide a concrete slipform for the purpose of lining upright shafts or like excavations whereby the slipform is elevationally moved within the shaft for the purpose of lining the shaft with monolithic concrete by pushing force exerted through pressure applied upwardly through the wet concrete against the form members.

Another object is to provide such an apparatus that will move upwardly with an upright shaft at a rate corresponding to the rate that concrete is received between the forming members and thereby presents little problem in the area of flow control and rate of ascent for the form members.

A still further object is to provide such an apparatus that requires substantially fewer drive and control mechanisms than prior apparatus and thereby is relatively more economical to utilize than previous lining mechanisms.

A still further object is to provide a shaft lining apparatus that provides a hydraulic seal between an outer forming member and the shaft walls to thereby present relatively friction free engagement of the lining members with the shaft wall surfaces.

These and still further objects and advantages will become apparent upon reading the following detailed description which, taken with the accompanying drawings, disclose a preferred form of my invention. It should be noted however that the following description is not intended to place restrictions upon my invention and that only the claims found at the end of the specification are to be taken as limitations on my invention.

BRIEF DESCRIPTION OF THE DRAWINGS

FIG. 1 is a diagrammatic vertical section taken through an upright shaft, showing the present slipform assembly in operation;

FIG. 2 is an enlarged vertical cross-sectional view taken through the present assembly and surrounding environment when in operation;

FIG. 3 is an elevational view of the present apparatus with a portion thereof in cross section;

FIG. 4 is a sectional view taken along line 4—4 in FIG. 3;

FIG. 5 is a sectional view taken along line 5—5 in FIG. 3; and

DETAILED DESCRIPTION OF A PREFERRED EMBODIMENT

Figure 6:
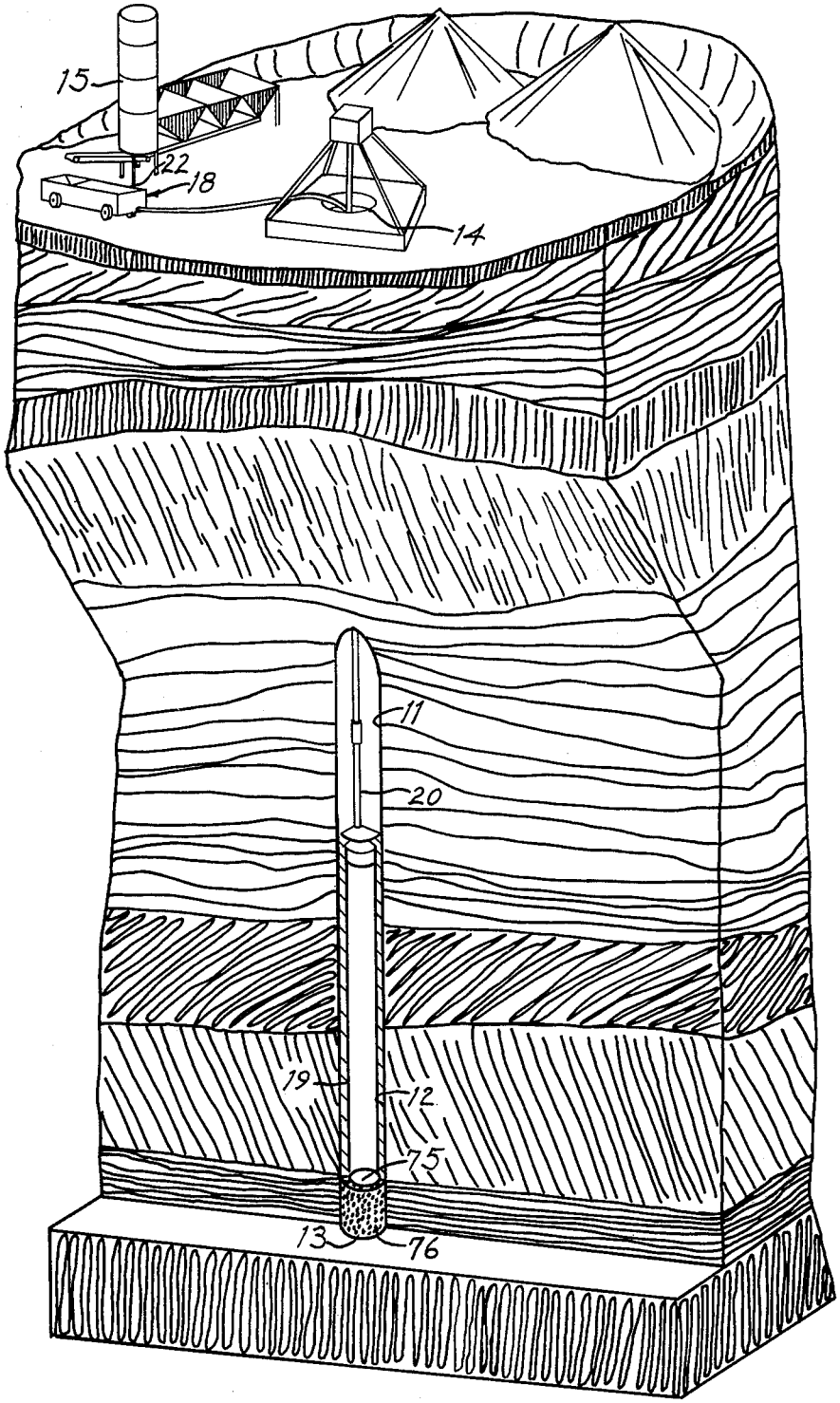
FIG. 6 is a pictorial schematic view showing the present invention in operation forming a ventilation shaft.

The apparatus of the present invention is illustrated in the accompanying drawings and is generally designated therein by the reference character 10. It is intended that the present slipform 10 be utilized within upright shafts such as that shown at 11 in FIG. 1. Such a shaft must include upright walls 12 of substantially continuous cross-sectional configuration along its length. The shaft should have a closed bottom 13, but in the case of a shaft extending between two elevationally spaced tunnels, no closed bottom is absolutely necessary.

The present slipform 10 is operated from an upper open end 14 of the shaft 11. A derrick or other appropriate control and concrete supply source 15 may be located at the upper open shaft end 14 to control operation of the slipform 10 and to deliver concrete from a mixing station or supply hopper (not shown) to the slipform.

The slipform itself basically includes an outer form member 16 and an inner core member 17. A pressure supply means 18 is provided for directing concrete under pressure between the form members 16 and 17 and thereby against the wall of shaft 11 to form a continuous concrete lining 19 along the full length of shaft 11.

Concrete is delivered to the slipform 10 through an umbilical "tremie tube" 20. Tube 20 may be flexible by nature and progressively wound or unwound from a coiled length, or it may be supplied as rigid tube in successive interconnected lengths. This tube 20 or an attached cable (not shown) need only to support the weight of the slipform 10 while it is being lowered into the shaft. No excessive tension is necessarily applied to the tremie tube in order to pull the slipform upwardly. Only sufficient force to lift the weight of the concrete filled tube is necessary during the lining forming operation.

Means 18 is provided in the form of a pump 22 to deliver concrete at pre-selected pressure through the tremie tube 20 to slipform 10. As will be understood below, the pump means is operated to supply pressure which in turn effectively raises the slipform within the shaft 11.

The outer form member 16 is shown in substantial detail by FIGS. 2, 3, and 4. As shown, the outer form member 16 is substantially conical in configuration. It includes a continuous conical wall surface 31 that extends from an upper end 32 to a lower edge 33. Lower edge 33 is substantially complementary to the cross-sectional configuration of shaft 11 which is shown as being cylindrical. The upper end 32 includes facilities for mounting the supply pipe 20 through a conventional releasable connector member.

A seal means 24 is provided between the outer form member 16 and the shaft 11 through an upright cylindrical wall 34. Wall 34 is an integral portion of the outer form member 16 and is located thereon at the lower conical edge 33. Wall 34 is continuous about the form member 16 and is parallel along its length (the length dimension being with reference to the length dimension of the shaft 11) to the shaft wall 12. The cross-sectional dimension of the cylindrical wall 34, however is somewhat less than the same dimension of shaft 11. Therefore, the wall 34 is spaced slightly inwardly adjacent to the shaft wall 12.

The cylindrical wall 34 includes an upper edge 35 and a lower edge 36. Concrete may enter between the outer surfaces of walls 34 and 12. However, wall 34 is spaced closely adjacent to the complementary shaft wall 12 so upward concrete flow is severely restricted. Because of this restriction, the concrete will not overflow the upper wall edge 35 unless excessive pressure is applied by pump means 22. If the pump means is regulated to maintain a preselected hydraulic pressure, the concrete level may be maintained between wall 34 and shaft wall 12. Thus, through means 24, the slipform 10 is capable of "floating" on the concrete delivered thereto through tremie line 20. As more concrete is delivered, the slipform will move upwardly until the entire shaft is lined.

The inner core member 17 is mounted to outer member 16 by a number of radial brace members 38. These members 38 extend between member 17 and the lower edge of outer member 16. A circular base frame 39 may be provided to rigidly interconnect the brace members and more securely mount core member 17 to form member 16.

The inner core member 17 includes an upper conical member 41 that is complementary and spaced inwardly of the conical wall surface 31 of outer member 16. The upper conical member 41 is joined at a lower edge thereof to a lower cylindrical member 42. It is the cylindrical member 42 that defines the inside cross-sectional configuration of the lining 19.

An upper open end 44 of conical member 41 includes a dump plug assembly 45. The assembly 45 includes a dump cylinder 46 attached to a "bullet" shaped plug that fits within the opening 44. The dump cylinder 46 may be selectively operated to lower the plug from engagement with the opening and thereby allow concrete to fall into the central opening area without being passed between the form members to become a part of lining 19. The plug assembly is provided as a precaution against premature curing of the concrete within the tube 20. Such curing may be detected and the dump assembly operated to quickly flush the concrete from the tube.

It is probable but not necessary that the slipform 10 be utilized in shafts that are full, or have been previously filled with "drilling mud" or water. This situation is, in fact, desirable in that the water initially supports the shaft wall, preventing sloughing, and subsequently will assist curing of the lining and operate as another media for enabling upward movement of the slipform in response to hydraulic pressure applied thereto.

When the shaft 10 is full of water, a vent must be provided between the area below slipform 10 and the area immediately above. A vent tube 50 is provided that interconnects the form member 16 and 17.

It is important to discuss the construction of the cylindrical wall section 42 and its function in relation to the present method and apparatus. The cylindrical member 42 extends along an axis that is coaxial with the longitudinal upright center line of shaft 11. The cylinder is constructed of a sheet material having longitudinal side edges 56 that overlap one another. Edges 56 are joined together at an upper end by a pivot pin 57. A hydraulic ram cylinder 58 connects the overlapping edges 56 at a lower end of member 42. A bracket 59 mounts one end of ram 58 to one side of the overlapping joint while a bracket 60 mounts the remaining end of ram 58 to the cylinder 42 on the opposite side of the joint. Ram 58 may be selectively operated to extend or retract and thereby expand or contract the effective cross-sectional diameter of the member 42 at the lower end thereof.

Contraction of the ram 58 results in corresponding contraction of the cylinder member 42 at its lower end to facilitate disengagement of the cylinder with the lining. Thus, if the concrete around the cylindrical portion 42 were to harden prematurely, the ram 58 would be contracted to disengage the surface from the lining and allow the slipform to be lifted from engagement with the lining. Conversely, extension of the ram 58 will cause corresponding expansion of the cross-sectional diameter of member 42. This expansion may also be useful in providing a gripping force between the slipform and a plug means 64 described below.

The plug means 64 is shown constructed of metal material in substantial detail by FIG. 2. It is releasably attached to the lower end of cylindrical member 42 in order to provide a surface for the concrete to operate against as the shaft lining is initially formed. Plug means 64 provides a surface between core member 17 and the shaft wall 12 against which the concrete may react to lift the slipform upwardly at a desired rate.

The plug means 64 includes upright tubular walls 65 of an outside diameter slightly less than the shaft diameter. The plug also includes a horizontal bottom 66. A vent hold 67 is formed through the bottom 66 to allow free movement of water from the area below the slipform to the area above during movement of the slipform downwardly to the shaft bottom. The plug means 64 may be formed of concrete in order that it may become an integral part of the lining.

In conjunction with the plug means 64, a number of dump valves 69 are provided to facilitate pouring of concrete into the area surrounded by cylindrical member 42 and against the plug bottom 66. This condition is shown in FIG. 2. The dump valves 69 are simple slide plates 70 that are interconnected and raised or lowered by means of paired opposed cylinders 71. Thus, when the plug means 64 is located at the shaft bottom, the dump valves may be actuated to allow concrete to flow into the central area and settle on the plug bottom 66 to seal the vent hole 67. When the valves 69 are closed, the pressurized concrete reacts against the form members to lift them upwardly, and initiate the upward progress of the slipform within the shaft.

It should be emphasized at this point that the plug means 64 and the corresponding valves 69 are optional items and are not necessary under certain circumstances. Specifically, the plug and valve arrangement can be used when slipforming a winding shaft or where the shaft is to have a closed, sealed bottom (FIGS. 1 and 2). This arrangement is not necessary when a shaft is to have an open lower end. Ventilation shafts, such as that shown schematically in FIG. 6, have lower ends that open directly into open "rooms" within the ore seam (especially used in coal mining).

Movement of the slipform within shaft 11 is guided through means of a set of ski members 72. Ski members 72 are pivotably mounted to the outer form member 16 through parallelogram type linkages 73. Each member 72 is also interconnected to the outer form members 16 by a selectively operable cylinder 74. Thus, the skis may be pivoted into engagement with the shaft wall 12 to center the slipform within the shaft opening and hold it in that position as it is moved upwardly. The skis may be disengaged from the shaft wall and held radially inward of the walls 12 to permit free movement of the slipform downwardly into the shaft.

Each cylinder 71 may be operated independently through conventional valve controls to selectively vary the position of the slipform within the shaft 11. Thus, some slight variation in the shaft walls may be accommodated by independently controlling the cylinders to maintain the slipform within the shaft center. If the shaft is completely smooth along its entire length, these cylinders may be operated in unison to move the skis into engagement with the shaft wall 12, centering the slipform. No further adjustment of the cylinders would then be necessary to cause corresponding lateral adjustment of the slipform within the shaft.

A vibrator mechanism is provided between the inner core member 17 and shaft walls 12 to enable vibration of the wet, plastic concrete as it is delivered and formed in place against the shaft wall. The vibrator is positioned in relation to the radial support braces 38 so as to increase fluidity and consolidate the concrete at a point downstream of the brace members.

It has been found that the radial members will segregate the aggregate from the wet cement mixture and thereby leave vertical lines in the finished lining that will crack under excessive stress. To prevent this separation, the vibration consolidator is located directly downstream of the braces and at a position where the concrete is still in a plastic state, during the process of forming the lining 19. A circular ring 76 extends about the area between inner core member 17 and shaft wall 12. It is located at the center of mass for the concrete between the member 17 and wall 12. Vibration is imparted to the ring 76 through radial spokes 77. Spokes 77 are, in turn, operatively connected to a central vibration motor 78. The ring will vibrate at a fixed frequency in response to operation of motor 78. As the slipform is moved upwardly, the vibrating ring will move through the wet concrete. It serves to consolidate the wet cement with the aggregate and to liquify the concrete so it will conform or mold itself tightly against the shaft wall.

It is preferable that the present slipform be utilized with a portland cement concrete mixture that is capable of being pumped through a tremie tube 20 and that will form readily about the inner core member 17. Ordinarily, no reinforcement is utilized with monolithic shaft linings formed by a slipform. However, recently developed reinforcing fibers (either glass or metal) may be pumped along with the concrete to provide structural reinforcement to the finished lining.

The present method of operation by which the shaft 11 is lined with concrete may now be more readily understood from the above technical disclosure of the present apparatus. Prior to the actual forming operation, the slipform unit must be lowered to the bottom of shaft 11. This is done by positioning the slipform directly over the shaft 11 and lowering it gradually through the open end 14. The skis 72 are held away from engagement with the shaft walls 12 while the slipform is lowered. However, if the slipform binds in the shaft, the skis may be used to re-center the slipform and allow for the downward progression of the slipform.

As the slipform is being lowered, the tremie tube 20 is played out or successive tubing sections are added as the distance increases between the slipform 10 and upper shaft opening 14.

The lining forming process may begin once the slipform 10 reaches the shaft bottom.

Assuming that the shaft is filled with water, the first step is to purge the pipe and slipform of water ahead of the concrete being delivered. This is accomplished by placing a "rabbit" or slidable plug in the tube 20 directly ahead of the concrete being pumped. The pumped concrete forces the "rabbit" to head downwardly through the tube and into the slipform 10. The "rabbit" will thereby force water within the tube downwardly and out through the slipform.

The "rabbit" however cannot flush all the water from the slipform 10. Therefore, the slipform is allowed to remain at rest at the shaft bottom 13 while sufficient concrete is pumped through the dump valves 69 to displace the water remaining within the space between core member 17, outer member 16 and the adjacent shaft wall 12.

When dump valves 69 and plug are being used as shown in FIG. 2, the pumped concrete is dumped through valves 69. The extremely wet concrete mixture will settle against the bottom of plug 64 to seal the vent hole 67 therein.

When sufficient concrete has been pumped through the stationary slipform and onto the plug 64, the dump valves 69 may be closed to prevent further escape of concrete into the inner portion of the lining bore. As the dump valves 69 are closed, the pumped concrete is built up against the upper edge of plug means 64. Since the concrete mixture will not compress, it produces a reaction force against the form members 16 and 17. Members 16 and 17 have no alternative but to start moving upwardly with the shaft 11.

As the dump valves 69 are closed, the plug means 64 is released from engagement with the cylindrical member 42. This may be done by slightly retracting the cylinder 58 to decrease the operative diameter of member 42 and allow upward movement thereof through the tubular wall 65. However, other mechanisms may be provided for performing this function such as explosive bolts or some form of lock-releasing mechanism.

Once the plug means 64 has been released, the slipform 10 is free to move upwardly along the tubular walls of plug means 64. The length of the tubular walls 64 is coordinated with the desired upward motion of slipform 10 so that when the bottom edge of cylindrical member 42 leaves engagement with the walls 64, the concrete placed against the upper plug edge will have hardened to a self-supporting state. The rate of ascent for slipform 10 is held continuous at that same rate so that the concrete deposited and formed by the slipform will not crumble under its own weight.

A somewhat different approach may be taken to initiate the lining process if the plug means is not used as in the case of an open ended ventilation shaft. In such instances the lining bottom is located upwards of the shaft bottom (FIG. 6). A false shaft bottom 75 is provided by a gravel fill 76 that is as deep as the seam.

The slipform is lowered to within a few inches from the "false" shaft bottom 75. The pump means is activated and the tremie line and slipform are purged of water or drilling mud by means of the "rabbit" as described above. The purged material exits from under the slipform and subsequently out through vent tube 50. The purging is continued until pure undiluted concrete starts to flow from under the form bottom. At this point, the form is lowered the few inches to engage the false shaft bottom. The undiluted concrete then acts upwardly against the form members, lifting them upwardly and initiating the slipforming action. (The gravel fill 76 may be removed after the lining operation to allow open access to the ore seam, leaving the lining 19 to be supported by the shaft wall 12).

The seal means 24 assures that no wet concrete will escape upwardly over the outer form member and into the area within the shaft above the slipform. The rate of ascent for slipform 10 may be controlled simply by controlling the pressure at which the concrete is pumped downwardly into the slipform. This rate is timed in accordance with the setting time for the concrete.

Should an occasion arise wherein the concrete being pumped downwardly to the slipform begins to solidify before it reaches the form, the dump cylinder 46 may be operated to open the conical member 41 and allow evacuation of the hardening material from the tube 20. This material will fall harmlessly down to the shaft bottom.

Should the concrete harden unexpectedly between the core member 17 and shaft walls 12, the ram 58 may be retracted to decrease the effective diameter of cylindrical member 42 and thereby disengage the core member from the hardened material.

The concrete is delivered continuously to the slipform which, in response to reception of the concrete, moves upwardly within the shaft 11 to the upper open end 14. The form members 16 and 17 operate to form the concrete into an open monolithic concrete lining that extends the full length of the slipform 10 from its bottom 13 to open end 14. However, it is not necessary that the lining be performed in one continuous pour. The provision of the several dump valves and ability of the cylindrical member 42 to contact from engagement with the concrete enables the operators to leave the slipform in place within the shaft for extended periods of time without fear of concrete setting up within the slipform or pipe 20.

It may have become obvious from the above description that various changes and modifications may be made therein. It is therefore intended that only the following claims be taken as definitions of the present invention.

I claim:

1. Slipform apparatus for lining in situ an elongated upright open vertical walled shaft having a substantially circular cross section extending from a shaft bottom to an open top, said slipform apparatus comprising:

an outer slipform member having a conical shape extending downward and radially outward from an open apex to a peripheral edge adjacent the vertical wall of the shaft;

an inner core slipform member mounted in coaxial spaced relation to the outer conical slipform member;

said inner core slipform member having (1) a conical upper portion coaxial with and spaced from the outer conical slipform member forming a conical passageway extending between the open apex downward and radially outward to the peripheral edge of the outer slipform member and (2) a depending lower cylindrical wall portion to form a cylindrical space between the wall portion and the shaft wall;

an elongated tremie tube means connected to the outer slipform member with a lower end in open communication with the open apex of the outer slipform member for directing concrete in a plastic state down the tremie tube through the open apex and through the conical passageway and into the cylindrical space between the cylindrical wall portion and the shaft wall to form the shaft lining;

seal means on the outer slipform member at the peripheral edge for preventing the escape of concrete from the cylindrical space to above the outer slipform member; and concrete pressure supply means operatively connected to the tremie tube means for pumping concrete under sufficient pressure through the tremie tube means and the conical passageway to the cylindrical space between the cylindrical wall portion and the shaft wall to force the slipform apparatus upward within the shaft as the concrete is pumped through the tremie tube.

2. The slipform apparatus as defined by claim 1 wherein the depending lower cylindrical wall portion of the inner core slipform member is formed of a single sheet of material with overlapping longitudinal edges and wherein means operatively associated with said depending lower cylindrical wall portion is included for moving the longitudinal edges in opposite lateral directions to selectively change the diameter of the lower cylindrical wall portion.

3. The slipform apparatus as defined by claim 1 further includes an open ventilator duct joining the outer slipform member and the inner core slipform member.

4. The slipform apparatus as defined by claim 1 wherein the seal means is comprised of a cylindrical wall extending about the outer slipform member with an outward surface directly adjacent and parallel to the shaft wall.

5. The slipform apparatus as defined by claim 1 further including retractable guide means operatively associated with said outer slipform member selectively engageable with the shaft wall for centering the slipform members in the shaft.

6. The slipform apparatus as defined by claim 1 further comprising a concrete dump valve means on the inner core slipform member for dumping concrete directly from the conical passageway through the inner core slipform member to an area enclosed by the depending lower cylindrical wall portion.

7. The slipform apparatus as defined by claim 1 further comprising a tubular plug means removably mounted to the inner core slipform member.

8. The slipform apparatus as defined by claim 1 further comprising vibrator means operatively connected to the slipform members for vibrating the concrete in the cylindrical space between the cylindrical wall portion and the shaft wall.

* * * * *